US008478177B2

(12) United States Patent
Kurita et al.

(10) Patent No.: US 8,478,177 B2
(45) Date of Patent: Jul. 2, 2013

(54) RECORDING MEDIUM PEELING DEVICE, IMAGE FORMING DEVICE AND ADJUSTMENT METHOD

(75) Inventors: Atsumi Kurita, Ebina (JP); Shogo Kamiya, Ebina (JP); Yasunori Fujimoto, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 244 days.

(21) Appl. No.: 12/789,781

(22) Filed: May 28, 2010

(65) Prior Publication Data

US 2011/0135351 A1 Jun. 9, 2011

(30) Foreign Application Priority Data

Dec. 9, 2009 (JP) ..... 2009-279702

(51) Int. Cl.
*G03G 15/20* (2006.01)
*H05B 11/00* (2006.01)

(52) U.S. Cl.
USPC ..... 399/323; 399/122; 399/320; 399/399; 219/216

(58) Field of Classification Search
USPC ..... 399/320, 323, 399, 122; 219/216
See application file for complete search history.

(56) References Cited

U.S. PATENT DOCUMENTS 4,281,623 A * 8/1981 Kato et al. ..... 118/668
4,929,983 A * 5/1990 Barton et al. ..... 399/323
7,979,001 B2 * 7/2011 Miyata et al. ..... 399/122
2004/0146323 A1 * 7/2004 Fujisawa et al. ..... 399/323
2004/0146326 A1 * 7/2004 Ahn et al. ..... 399/358
2005/0084302 A1 * 4/2005 Masuda et al. ..... 399/322
2006/0198670 A1 * 9/2006 Baba et al. ..... 399/323
2007/0065189 A1 * 3/2007 Miyata et al. ..... 399/323
2007/0092277 A1 * 4/2007 Miyata et al. ..... 399/69
2008/0056782 A1 * 3/2008 Hotani ..... 399/323
2009/0003897 A1 * 1/2009 Yamada ..... 399/323
2011/0135350 A1 * 6/2011 Barton et al. ..... 399/323

FOREIGN PATENT DOCUMENTS

JP A 2008-151964 7/2008
JP A 2008-152021 7/2008

* cited by examiner

*Primary Examiner* — David Gray
*Assistant Examiner* — Francis Gray
(74) *Attorney, Agent, or Firm* — Oliff & Berridge, PLC

(57) ABSTRACT

A recording medium peeling device includes: a circularly moving section that has a moving surface circulating along a circulation course; and a pressing section that presses a recording medium passing through a pressing position in the circulation course, against the moving surface at the pressing position. The recording medium peeling device further includes: a peeling member that is disposed downstream from the pressing position in the circularly moving, is apart from the moving surface, is provided along the moving surface, extends in a direction crossing a direction of the circularly moving, and peels the recording medium after passing through the pressing position from the moving surface; and a protruding member that is disposed downstream from the peeling member in a direction in which the recording medium after being peeled by the peeling member proceeds, protrudes from the peeling member side to the recording medium side, and slopes downstream.

27 Claims, 18 Drawing Sheets

RECORDING MEDIUM PEELING DEVICE, IMAGE FORMING DEVICE AND ADJUSTMENT METHOD

CROSS-REFERENCE TO RELATED APPLICATION

This application is based on and claims priority under 35 USC 119 from Japanese Patent Application No. 2009-279702, filed Dec. 9, 2009.

BACKGROUND (i) Technical Field

The present invention relates to a recording medium peeling device and an image forming device.

(ii) Related Art

In an electrophotographic type image forming device used as a copier, a printer or a facsimile, a recording medium is pressed against a moving surface for transferring and fixing an image.

SUMMARY

According to an aspect of the invention, a recording medium peeling device includes:

a circularly moving section that has a moving surface circulating along a circulation course;

a pressing section that presses a recording medium passing through a pressing position in the circulation course, against the moving surface at the pressing position;

a peeling member that is disposed downstream from the pressing position in the circularly moving, that is apart from the moving surface, that is provided along the moving surface, that extends in a direction crossing a direction of the circularly moving, and that peels the recording medium after passing through the pressing position from the moving surface; and a protruding member that is disposed downstream from the peeling member in a direction in which the recording medium after being peeled by the peeling member proceeds, that protrudes from the peeling member side to the recording medium side, and that slopes downstream.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below with reference to the drawings.

Figure 1:
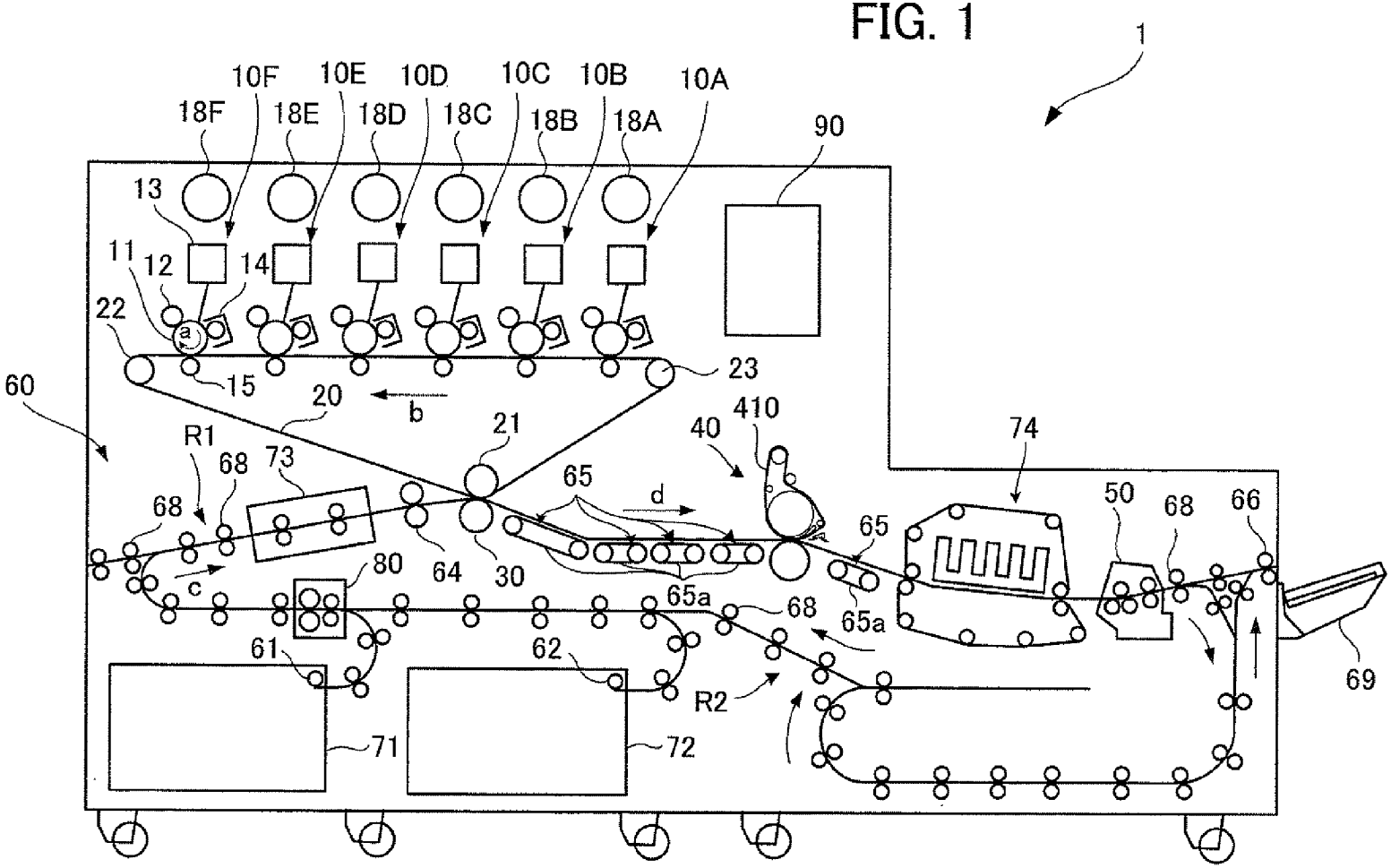
FIG. 1 is a schematic structural diagram that illustrates an exemplary embodiment of the image forming device according to the present invention.

FIG. 1 is a schematic structural diagram that illustrates an exemplary embodiment of the image forming device according to the present invention.

An image forming device 1 illustrated in FIG. 1 forms a toner image by forming an electrostatic latent image with a toner and developing the electrostatic latent image, and then transfers and fixes the toner image to a paper sheet, thereby finally forming an image formed by the fixed toner image on the paper sheet. Incidentally, this image forming device 1 accepts not only a paper sheet-i.e. a paper recording medium, but a resinous recording medium represented by an OHP sheet. However, the following description will be provided by using the paper recording medium as a representative example unless otherwise specified. The image forming device 1 is a tandem type of color printer in which six image forming sections 10A, 10B, 10C, 10D, 10E and 10F that respectively form images of mutually different colors are disposed in parallel. The image forming device 1 is capable of printing a single-colored image in a single-color mode and a color image formed by toner images of plural colors in a full-color mode. For example, among the six image forming sections 10A through 10F, the four image forming sections 10C, 10D, 10E and 1OF correspond to yellow (Y), magenta (M), cyan (C) and black (K), respectively, and the remaining two image forming sections 10A and 10B correspond to spot colors except these YMCK colors. The spot colors include, for example, colors that are not easy to precisely express by the combination of YMCK, such as a color that represents a particular company, pastel colors, and transparent colors for luster. The image forming device 1 includes six toner cartridges 18A, 18B, 18C, 18D, 18E and 18F that contain toners of the colors corresponding to the image forming sections 10A through 10F, respectively.

Since the six image forming sections 10A through 1OF have similar structures, the image forming section 1OF corresponding to black will be described as representing these six image forming sections. The image forming section 1OF includes a photoreceptor 11, a charging device 12 that charges the surface of the photoreceptor 11, an exposure device 13 that irradiates the photoreceptor 11 with exposure light based on an image signal supplied externally, a developing device 14 that develops the surface of the photoreceptor 11 with a toner, and a primary transfer device 15 that transfers the toner image to an intermediate transfer belt 20. The photoreceptor 11 has a surface in the shape of a cylinder and rotates in the direction of an arrow "a" around an axis of the cylinder.

Further, the -image forming device 1 includes the intermediate transfer belt 20 to which the toner image is transferred from the photoreceptor 11 of each of the image forming sections 10A through 10F, a secondary transfer device 30 that transfers the toner image from the intermediate transfer belt 20 to a paper sheet, a fixing device 40 that fixes the toner yet to be fixed on the paper sheet, a decurler 50 that corrects a curl of the paper sheet, and a paper conveyance section 60 that conveys the paper sheet along a conveyance course 1 and a front-and-back inversion course R2. Furthermore, the image forming device 1 includes paper containers 71 and 72 that contain the paper sheet(s), a deburring device 80 that removes a burr of the paper sheet before image formation, and a posture correcting section 73 that corrects the posture of the paper sheet. The image forming device 1 further includes a cooling section 74 that cools the paper sheet after the toner image is fixed, an output paper container 69 that receives the paper sheet after the image formation by the image forming device 1 is completed, and a controller 90 that controls each section of the image forming device 1. Here, the fixing device 40 is equivalent to an example of the recording medium peeling device according to the present invention. The fixing device 40 will be described later in detail.

The intermediate transfer belt 20 is a belt-shaped endless member supported by belt support rolls 21, 22 and 23, and circulates in the direction of an arrow "b" that passes by the image forming sections 10A through 10F and the secondary transfer device 30 in this order. Here, the combination of the image forming sections 10A through 10F and the intermediate transfer belt 20 is equivalent to an example of the image forming section according to the present invention.

The paper conveyance section 60 conveys the paper sheet along the conveyance course R1 and the front-and-back inversion course R2. The paper conveyance section 60 includes drawing rolls 61 and 62 that draw paper sheets from the paper containers 71 and 72, respectively, and a registration roll 64 that sends each of the paper sheets to the secondary transfer device 30 in timing for the transfer of the toner image by the secondary transfer device 30. The paper conveyance section 60 further includes belt conveyance devices 65 that convey the paper sheet from the secondary transfer device 30 to the fixing device 40 and from the fixing device 40 to the cooling section 74 while making the paper sheet cling to the external circumferential surfaces of belts 65*a*, and an output roll 66 that outputs the paper sheet to the outside of the image forming device 1. The paper conveyance section 60 further includes conveyance rolls 68 that are respectively disposed along the conveyance course R1 and the front-and-back inversion course R2 and convey the paper sheets. Incidentally, in FIG. 1, only a part of the conveyance rolls 68 in the image forming device 1 is indicated by a reference character for easy viewing. Here, the belt conveyance device 65 that conveys the paper sheet from the fixing device 40 to the cooling section 74 while making the paper sheet cling to the external circumferential surface of the belt 65*a* is equivalent to an example of the conveyance device that sucks and conveys the recording medium.

The paper conveyance section 60 conveys the paper sheet from each of the paper containers 71 and 72 along the conveyance course R1 passing through the deburring device 80, the posture correcting section 73, the secondary transfer device 30, the fixing device 40, the cooling section 74 and the decurler 50 sequentially. When double-sided printing is executed in the image forming device 1, the paper conveyance section 60 conveys the paper sheet along the front-and-back inversion course R2 diverging from the conveyance course R1 and returning to the conveyance course R1. The paper sheet is turned back and then turned upside down in the front-and-back inversion course R2. The paper sheet after being turned upside down returns to the conveyance course R1, subsequently passes through the deburring device 80 and the posture correcting section 73 again, and the toner image is transferred by the secondary transfer device 30 to the reverse side of the paper sheet, namely the side to which the toner image is yet to be transferred.

A basic operation of the image forming device 1 illustrated in FIG. 1 will be described. The description will be provided by taking the image forming section 10F corresponding to that of black (K) as a representative example. The photoreceptor 11 is driven to rotate in the direction of the arrow "a", and a charge is applied to the surface of the photoreceptor 11 by the charging device 12. The exposure device 13 forms an electrostatic latent image by irradiating the photoreceptor 11 with exposure light based on an image signal supplied externally. To be more specific, the exposure device 13 forms the electrostatic latent image on the surface of the photoreceptor 11 by emitting the exposure light based on data corresponding to black in the image signal. The developing device 14 forms a toner image by developing the electrostatic latent image with a black toner. The developing device 14 of the image forming section 10F is supplied with the toner by the toner cartridge 18F. The photoreceptor 11 retains the toner image upon formation of the toner image. The toner image formed on the surface of the photoreceptor 11 is transferred to the intermediate transfer belt 20 by the primary transfer device 15.

The five image forming sections 10A through 10E corresponding to the colors except black also respectively form toner images corresponding to the respective colors in a manner similar to the image forming section 10F corresponding to black. The intermediate transfer belt 20 is supported by the belt support rolls 21 through 23 and circulates in the direction of the arrow "b". The image forming sections 10A through 10F transfer the toner images of the respective colors to the intermediate transfer belt 20 where the toner images are superimposed. In this way, the toner images according to the image data are formed on the intermediate transfer belt 20, and the intermediate transfer belt 20 moves while retaining the toner images.

Meanwhile, the paper sheets in the paper containers 71 and 72 are taken out by the drawing rolls 61 and 62, and then conveyed along the conveyance course R1 in the direction of an arrow "c" by the conveyance roll 68 and the registration roll 64 toward the secondary transfer device 30. The deburring device 80 disposed in the conveyance course R1 removes a burr present at an edge of the paper sheet, and the posture and the position of the paper sheet are corrected by the posture correcting section 73. The secondary transfer device 30 transfers the toner images on the intermediate transfer belt 20 to the paper sheet, by applying a bias potential for transfer between the intermediate transfer belt 20 and the paper sheet.

The toner images are finally transferred to the paper sheet by the secondary transfer device 30 in this way. The paper sheet is then further conveyed in the direction of an arrow "d" by the belt conveyance devices 65, and the toner images transferred to the surface of the paper sheet and yet to be fixed are fixed by the fixing device 40. In this way, an image made up of the toner images is formed on the paper sheet. The fixing device 40 has a fixing belt 410 to raise thermal capacity. The paper sheet with the surface where the image is formed is cooled by the cooling section 74, and then a curl of the paper sheet is corrected by the decurler 50. Subsequently, the paper sheet is output by the output roll 66.

When double-sided printing is performed in the image forming device 1, the paper conveyance section 60 conveys, along the front-and-back inversion course R2, a paper sheet after being conveyed along the conveyance course R1. Along the front-and-back inversion course R2, the paper conveyance section 60 turns the paper sheet upside down and then conveys the paper sheet along the conveyance course R1 again. Meanwhile, when output of a paper sheet after being turned upside down is designated, although this is not the double-sided printing, the paper conveyance section 60 temporarily retracts, up to a midpoint of the front-and-back inversion course R2, the paper sheet after being conveyed along the conveyance course R1. Subsequently, the paper conveyance section 60 conveys the paper sheet in the reverse direction and then outputs the paper sheet. The output paper sheet is then laid in the output paper container 69.

Next, the fixing device 40, which is an exemplary embodiment of the recording medium peeling device according to the present invention, will be described in detail.

Figure 2:
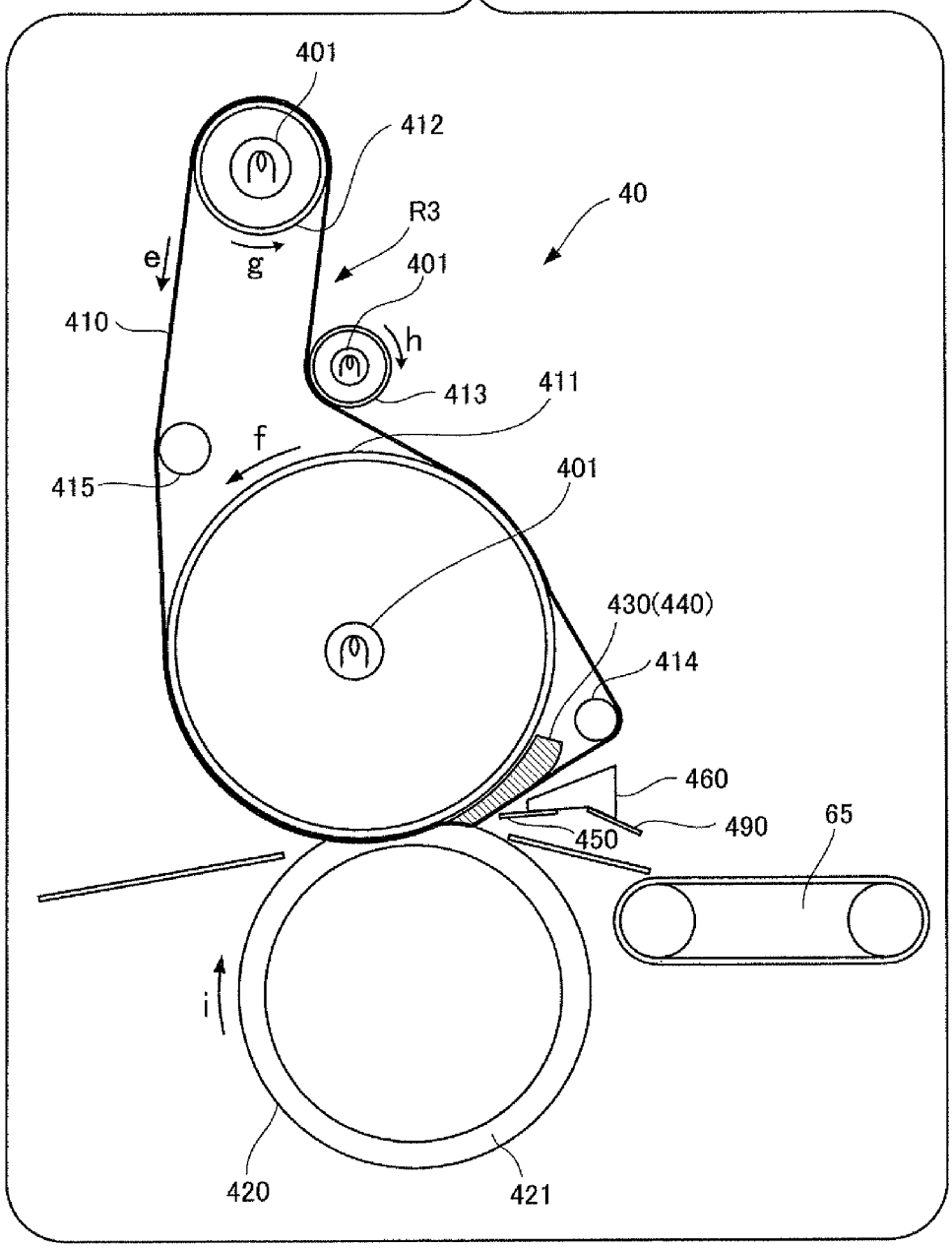
FIG. 2 is a schematic structural diagram of the fixing device 40 that is the exemplary embodiment of the recording medium peeling device according to the present invention.
Figure 3:
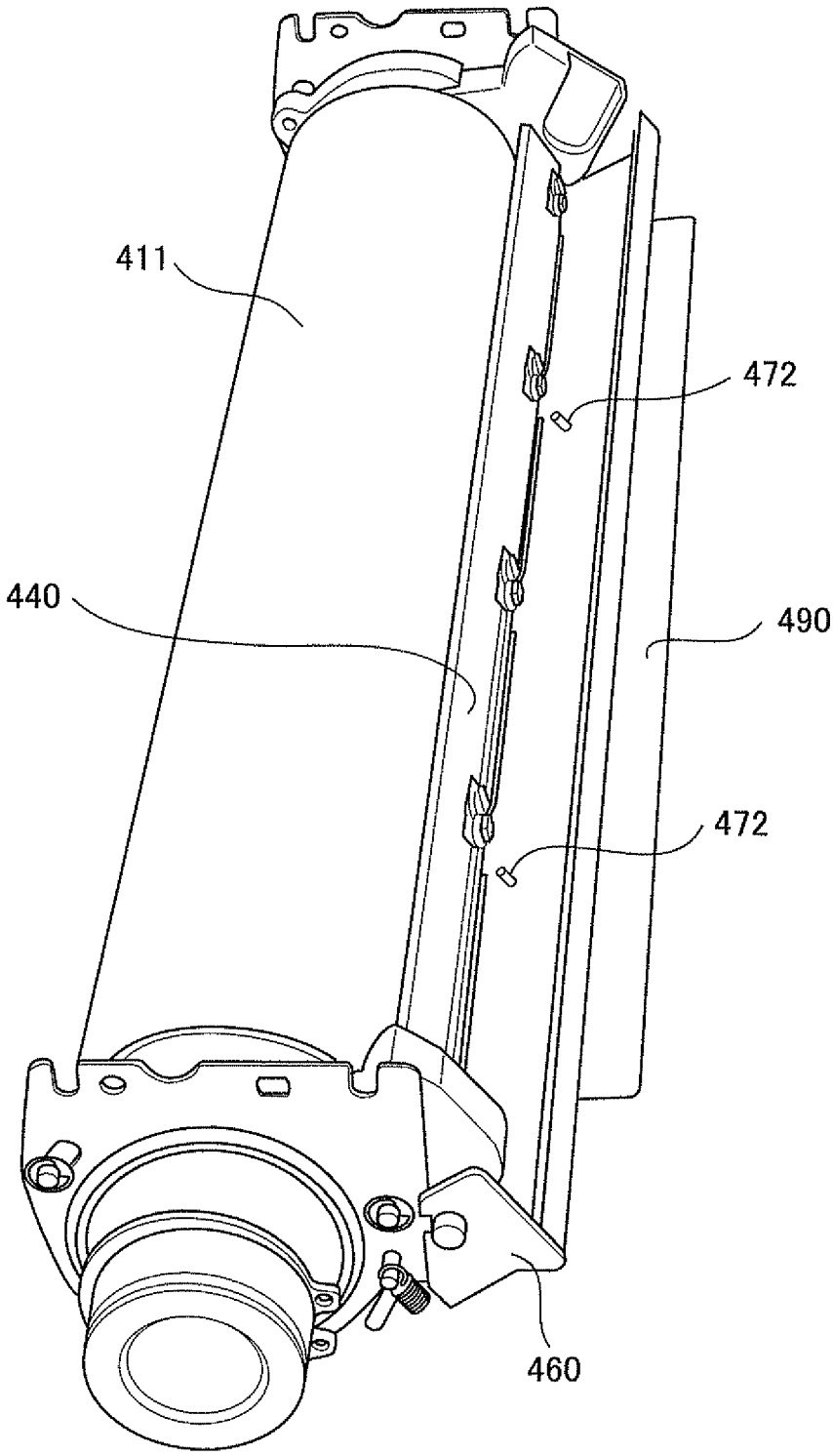
FIG. 3 is a perspective view of an assembly including a first heating roll, a peeling pad, a fixed member, a peeling baffle, a support base and a protruding member illustrated in FIG. 2, when viewed obliquely from upper front.
Figure 4:
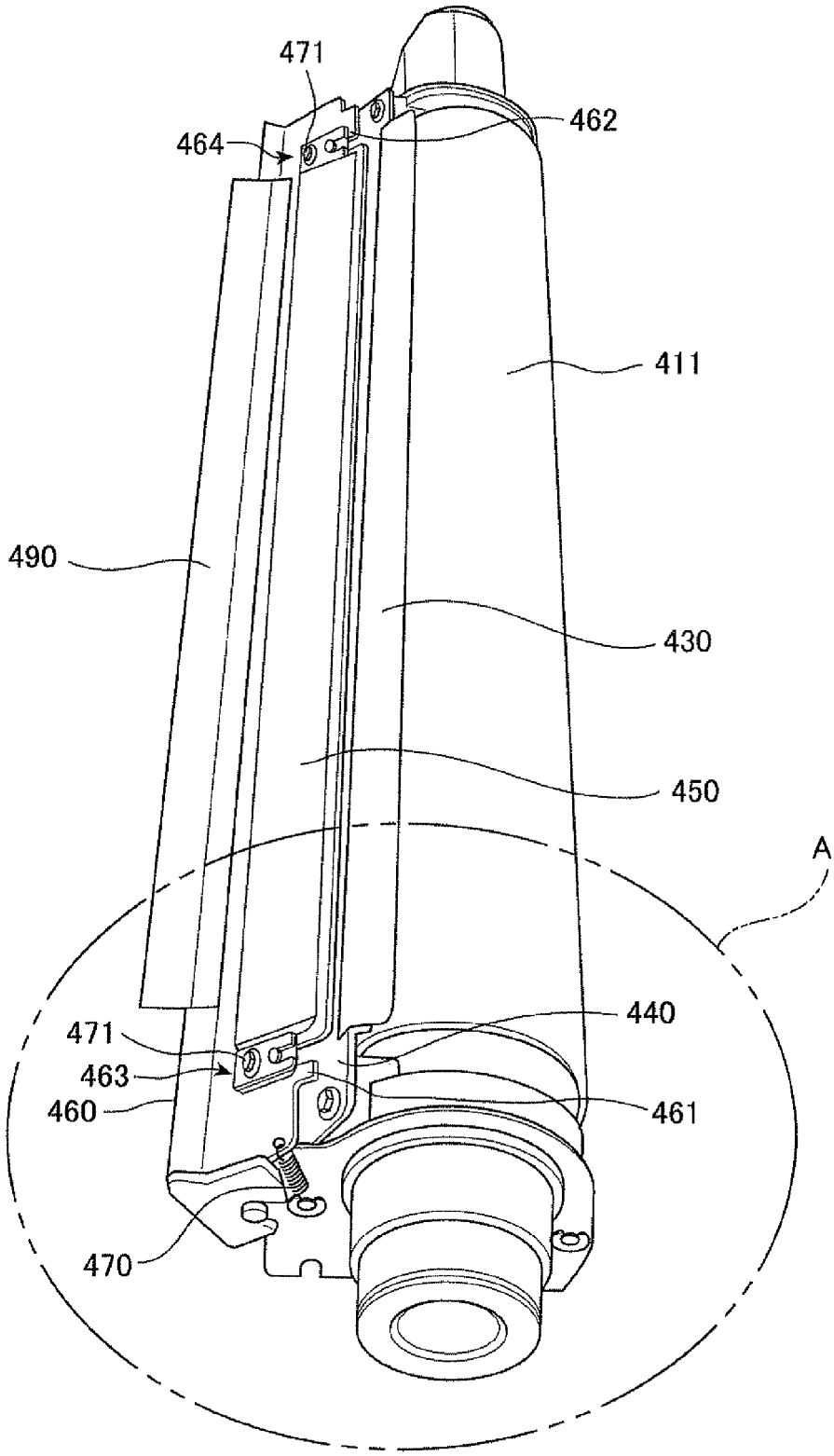
FIG. 4 is a perspective view of the assembly illustrated in FIG. 3 when viewed obliquely from lower front.
Figure 5:
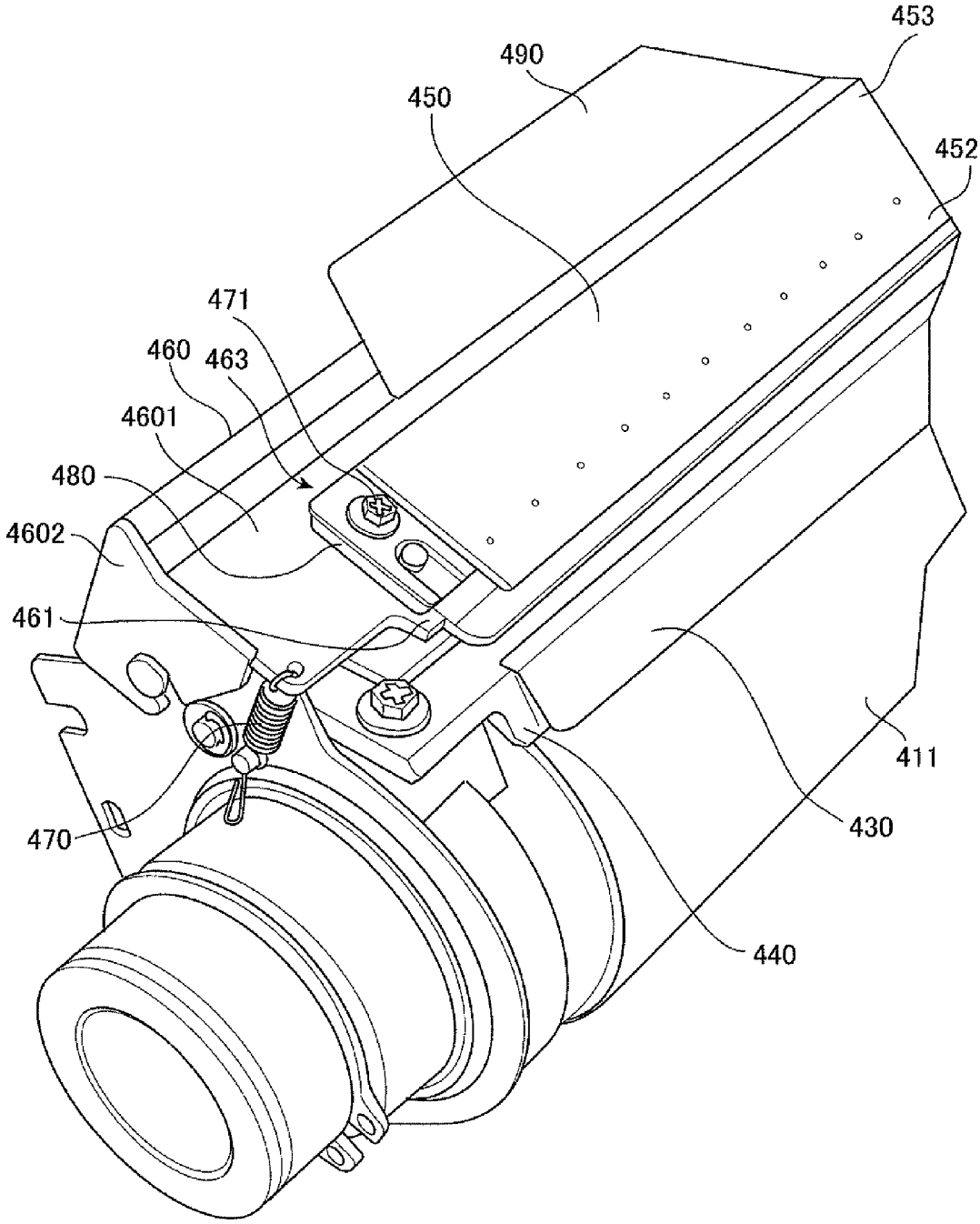
FIG. 5 is an enlarged perspective view of a part A illustrated in FIG. 4.

FIG. 2 is a schematic structural diagram of the fixing device 40 that is the exemplary embodiment of the recording medium peeling device according to the present invention. Further, FIG. 3 is a perspective view of an assembly including a first heating roll 411, a peeling pad 430, a fixed member 440, a peeling baffle 450, a support base 460 and a protruding member 490 illustrated in FIG. 2, when viewed obliquely from upper front. FIG. 4 is a perspective view of the assembly illustrated in FIG. 3 when viewed obliquely from lower front. FIG. 5 is an enlarged perspective view of a part A illustrated in FIG. 4.

As illustrated in FIG. 2, the fixing device. 40 includes a fixing belt 410 shaped like a loop and going around a circulation course R3. The fixing belt 410 is like a band and has an external circumferential surface serving as a moving surface that circulates while moving in the direction of an arrow "e" along the circulation course R3. The fixing device 40 further includes a pressing roll 420 pressed by the circumferential surface of the fixing belt 410.

The fixing belt 410 is supported by: a first heating roll 411, a second heating roll 412 and a third heating roll 413 each having a heat source 401 that emits heat; two tension rolls 414 and 415; and the peeling pad 430. The fixing belt 410 is an endless belt-shaped member made of resin such as polyimide. As illustrated in FIG. 2, the fixing belt 410 circulates along the circulation course R3 that runs through the first heating roll 411, the peeling pad 430, the tension roll 414, the first heating roll 411, the third heating roll 413, the second heating roll 412 and the tension roll 415 in this order. Further, the fixing belt 410 is heated by the heat source 401 provided in each of the first heating roll 411, the second heating roll 412 and the third heating roll 413. The fixing belt 410 is equivalent to an example of the circulating section having the moving surface that circulates along the circulation course, and each heat source 401 is equivalent to an example of the heat source that heats the moving surface.

The first heating roll 411 is a hard roll made of, for example, aluminum, and being in the shape of a cylinder as illustrated in FIG. 3 through FIG. 5. Further, as illustrated in FIG. 2, the first heating roll 411 is a drive roll that is driven to rotate in the direction of an arrow "f" around an axis of the cylinder, while holding the fixing belt 410 under a tension. The first heating roll 411 is disposed to face the pressing roll 420 and to be in contact with an internal circumferential surface of the fixing belt 410. In other words, the fixing belt 410 is interposed between the first heating roll 411 and the pressing roll 420, and a position between the first heating roll 411 and the pressing roll 420 is a pressing position.

The second heating roll 412 also is a hard roll made of, for example, aluminum, and being in the shape of a cylinder. Further, as illustrated in FIG. 2, the second heating roll 412 is a following roll that rotates in the direction of an arrow "g" around an axis of the cylinder while holding the fixing belt 410 under a tension. The second heating roll 412 is disposed at a position away from the first heating roll 411 and contacts the internal circumferential surface of the fixing belt 410. Furthermore, although detailed illustration is omitted, the second heating roll 412 is disposed to be capable of swinging in a direction that crosses a rotation axis direction, and has a so-called steering function to control meandering of the fixing belt 410 by the swing.

The third heating roll 413 also is a hard roll made of, for example, aluminum, and being in the shape of a cylinder. Further, as illustrated in FIG. 2, the third heating roll 413 is a drive roll that is driven to rotate in the direction of an arrow "h" around an axis of the cylinder. The third heating roll 413 is disposed downstream from the first heating roll 411 in the circulation and upstream from the second heating roll 412 in the circulation, and pressed against the external circumferential surface of the fixing belt 410. The rotating speed of the third heating roll 413 is slightly higher than the circulation speed of the fixing belt 410 and thereby, slack of the fixing belt 410 at a part between the pressing position and the third heating roll 413 is removed.

The peeling pad 430 is a member made of, for example, stainless steel and formed to be in the shape of a plate. This member includes a layer with a surface having a small coefficient of friction and heat resistance, and extends in a direction crossing the direction of the circulation. Further, as illustrated in FIG. 2, the peeling pad 430 is disposed to be in contact with the internal circumferential surface of the fixing belt 410, at a position downstream from the pressing position in the circulation and upstream from the peeling baffle 450 (to be described later) in the circulation. This peeling pad 430 pushes up the fixing belt 410 from the internal circumferential surface side to the external circumferential surface side of the fixing belt 410, causing an acute curve at a pushed-up point of the fixing belt 410, which helps to peel the paper sheet from the external circumferential surface of the fixing belt 410. The fixing belt 410 is equivalent to an example of the belt-shaped member forming a loop that circulates along the circulation course, and the peeling pad 430 is equivalent to an example of the pushing-up member that pushes up the belt-shaped member. The peeling pad 430 is, as illustrated in FIG. 3 through FIG. 5, secured to the fixed member 440 having a fixed position relative to the circulation course R3.

The fixed member 440 is a member made of, for example, aluminum, which extends along the peeling pad 430 and has hardness higher than the peeling pad 430. Further, the fixed member 440 is secured to a rotation shaft of the first heating roll 411, thereby having a fixed position relative to the circulation course R3. Furthermore, the peeling pad 430 is adhered to and thereby supported by the fixed member 440. The fixed member 440 is equivalent to an example of the fixed member having the fixed position relative to the circulation course.

The pressing roll 420 is a soft roll made of, for example, aluminum, having a circumferential surface where a resilient layer 421 is formed as illustrated in FIG. 2, and being in the shape of a cylinder. The pressing roll 420 is a roll pressed against the external circumferential surface of the fixing belt 410 and rotating in the direction of an arrow "i" around the cylinder. Between the pressing roll 420 and the first heating roll 411 disposed on the internal circumferential surface side of the fixing belt 410, the fixing belt 410 is clamped. A position where the fixing belt 410 is clamped is the pressing position in the circulation course R3. The pressing roll 420 presses the paper sheet, which has a surface where the toner image is yet to be fixed, against the external circumferential surface of the fixing belt 410 at the pressing position, thereby fixing the toner image on the surface of the paper sheet. The pressing roll 420 is equivalent to an example of the pressing section that presses the recording medium against the moving surface.

As illustrated in FIG. 2, the fixing device 40 includes, at a position downstream from the pressing position in the circulation, the peeling baffle 450 disposed apart from the external circumferential surface of the fixing belt 410 and the support base 460 supporting the peeling baffle 450.

Figure 6:
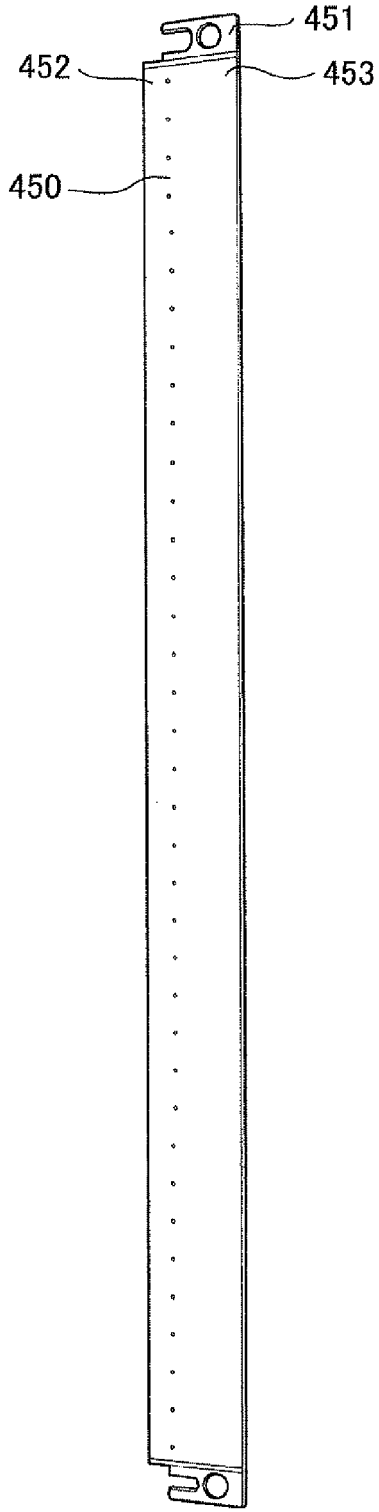
FIG. 6 is an external view of the peeling baffle.
Figure 7:
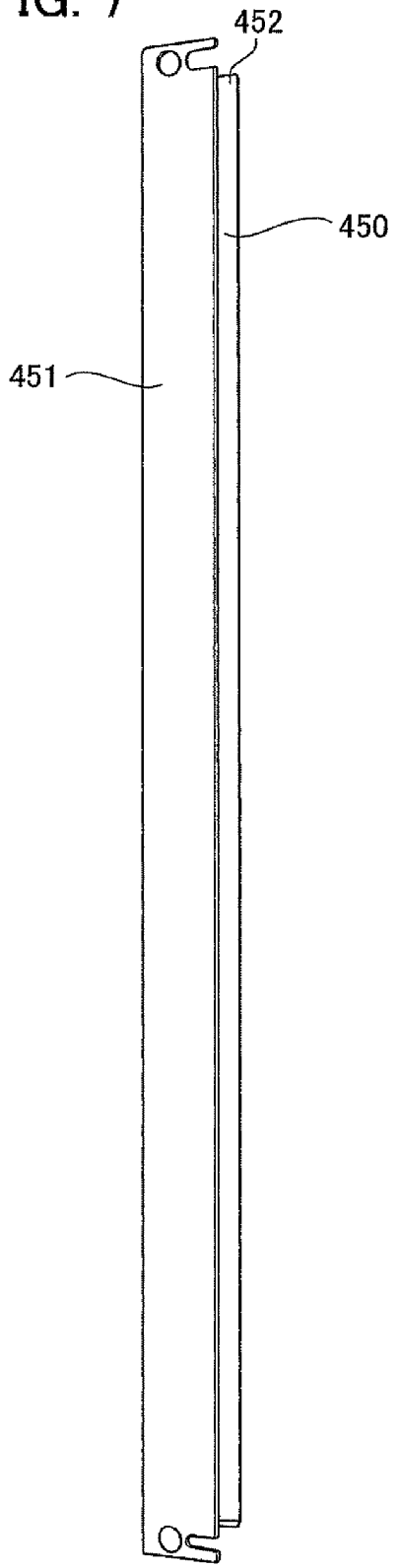
FIG. 7 is an external view of the peeling baffle illustrated in FIG. 6 when viewed from a side reinforced by a rear supporting plate.

FIG. 6 is an external view of the peeling baffle 450, and FIG. 7 is an external view of the peeling baffle 450 illustrated in FIG. 6 when viewed from a side reinforced by a rear supporting plate 451.

The peeling baffle 450 is a member made of, for example, stainless steel and having a surface where a layer with a small coefficient of friction and heat resistance is formed. As illustrated in FIG. 2, FIG. 4 and FIG. 5, this member is in the shape of a plate provided along the external circumferential surface of the fixing belt 410 and extending in a direction crossing the direction of the circulation. The peeling baffle 450 is in such a posture that, of two long sides 452 and 453 of the shape of the plate thus extending, the long side 452 is near the external circumferential surface of the fixing belt 410. Further, as illustrated in FIG. 6 and FIG. 7, the peeling baffle 450 is reinforced, from a side facing the support base 460, by the rear supporting plate 451 serving as a reinforcing member and made of, for example, stainless steel. The peeling baffle 450 and the rear supporting plate 451 are integrated with each other by, for example, laser welding, and then given a curve. The peeling baffle 450 is depressed due to this curve to protrude toward the support base 460, between two fixed points 463 and 464 which will be described later. However, this curve is corrected by the support base 460 as will be described later. By the peeling baffle 450 thus configured, the paper sheet after passing the pressing position is peeled off the external circumferential surface of the fixing belt 410. The peeling baffle 450 is equivalent to an example of the peeling member that peels the recording medium from the moving surface.

As illustrated in FIG. 4 and FIG. 5, the support base 460 is a member made of, for example, aluminum, extending along the peeling baffle 450, and having hardness higher than the peeling baffle 450. Here, the support base 460 is a member having such a structure that plate boards 4602 are respectively attached to both ends of a main body member 4601 by welding as illustrated in FIG. 5. Because an upper-left edge of the main body member 4601 in the figure is bent, torsional ridigity is enhanced.

Figure 8:
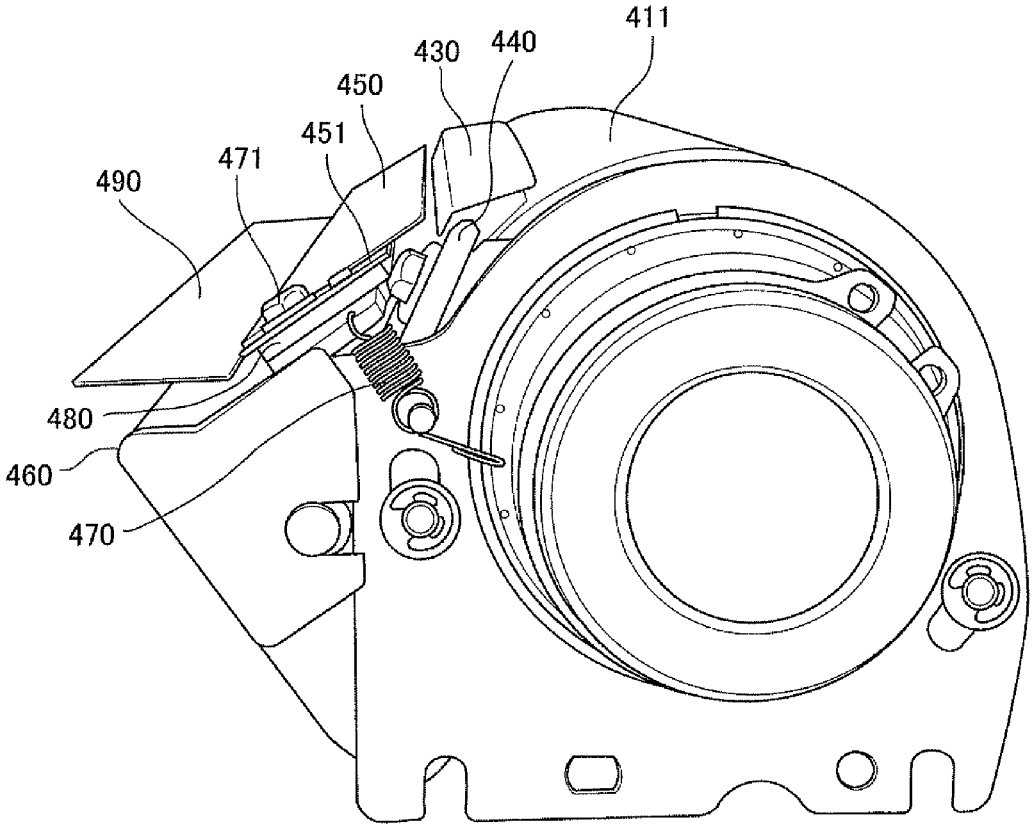
FIG. 8 is a side view of the part A illustrated in FIG. 4 in a state in which positioning projections of the support base abut against the fixed member.
Figure 9:
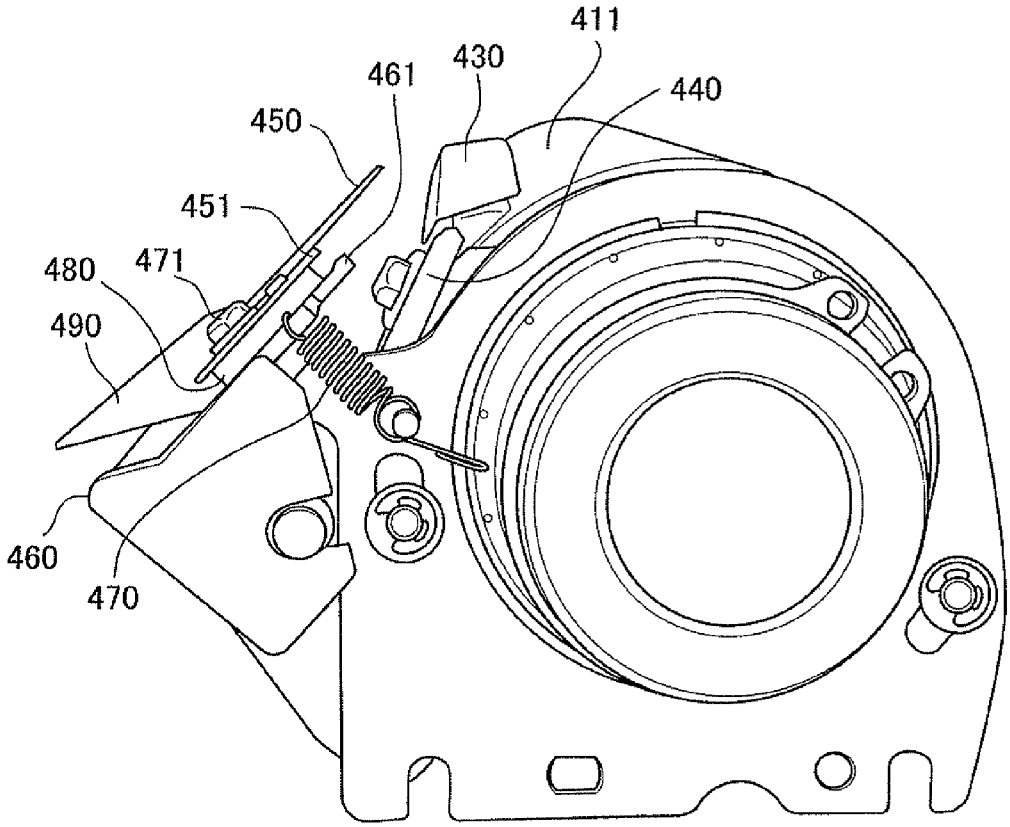
FIG. 9 is a side view of the part A illustrated in FIG. 4 in a state before the positioning projections of the support base abut against the fixed member.

FIG. 8 is a side view of the part A illustrated in FIG. 4 in a state in which positioning projections 461 and 462 of the support base 460 abut against the fixed member 440. FIG. 9 is a side view of the part A illustrated in FIG. 4 in a state before the positioning projections 461 and 462 of the support base 460 abut against the fixed member 440.

The support base 460 includes the positioning projections 461 and 462 at both ends in a direction crossing the direction of the circulation, and is movable in a predetermined movement path. When the positioning projections 461 and 462 are made to abut against the fixed member 440 as a result of movement of the support base 460 in the movement path, the support base 460 is positioned relative to the circulation course R3. Here, as illustrated in FIG. 8 and FIG. 9, a spring 470 is provided between an end of the support base 460 in the direction crossing the direction of the circulation and an end of the fixed member 440 in the direction crossing the direction of the circulation. The support base 460 is pressed by the spring 470 in a direction in which the positioning projections 461 and 462 of the support base 460 abut against the fixed member 440.

Figure 10:
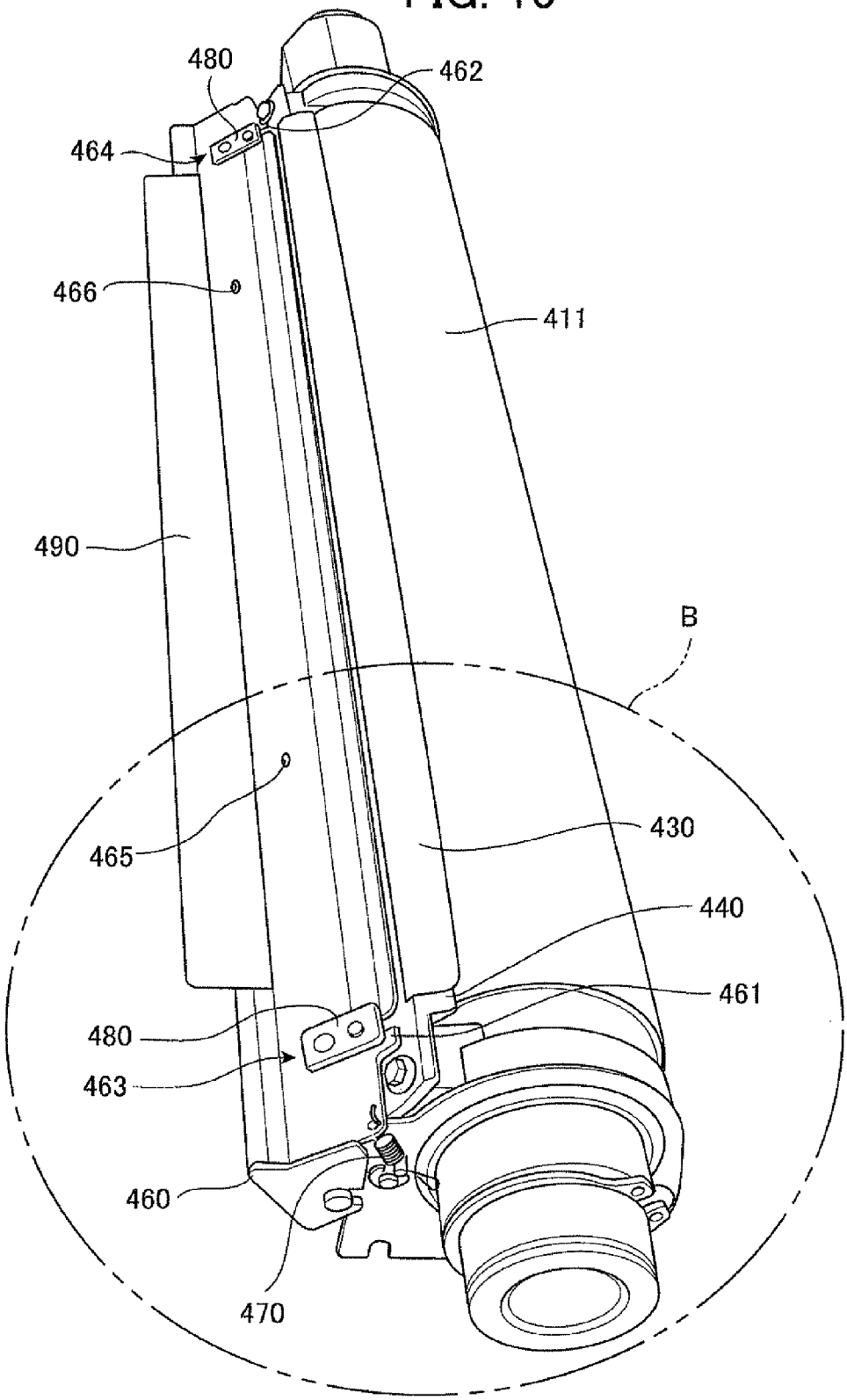
FIG. 10 is a perspective view of the assembly illustrated in FIG. 4 from which the peeling baffle is removed and which is viewed obliquely from upper front.
Figure 11:
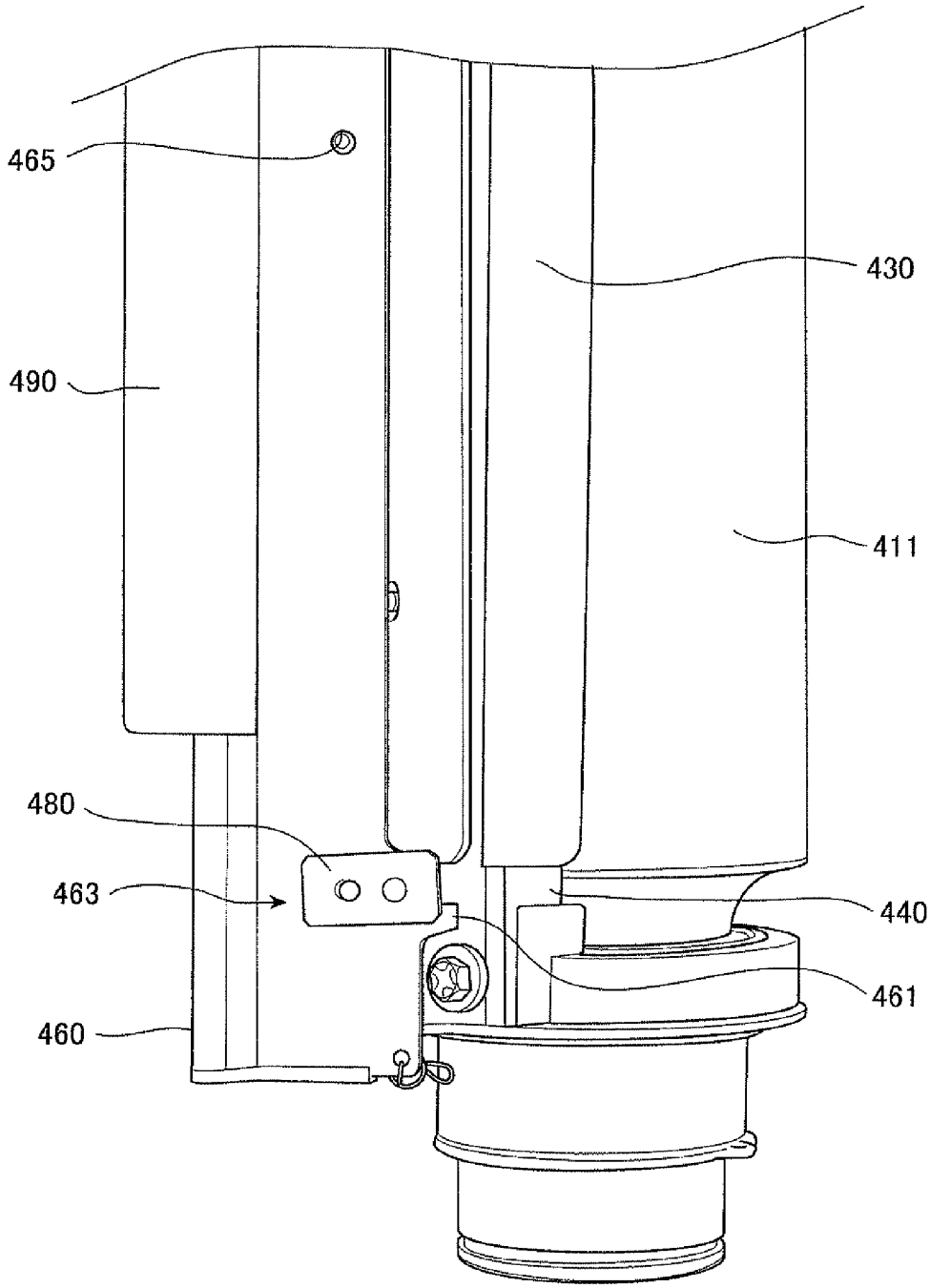
FIG. 11 is an enlarged external view of a part B illustrated in FIG. 10.
Figure 12:
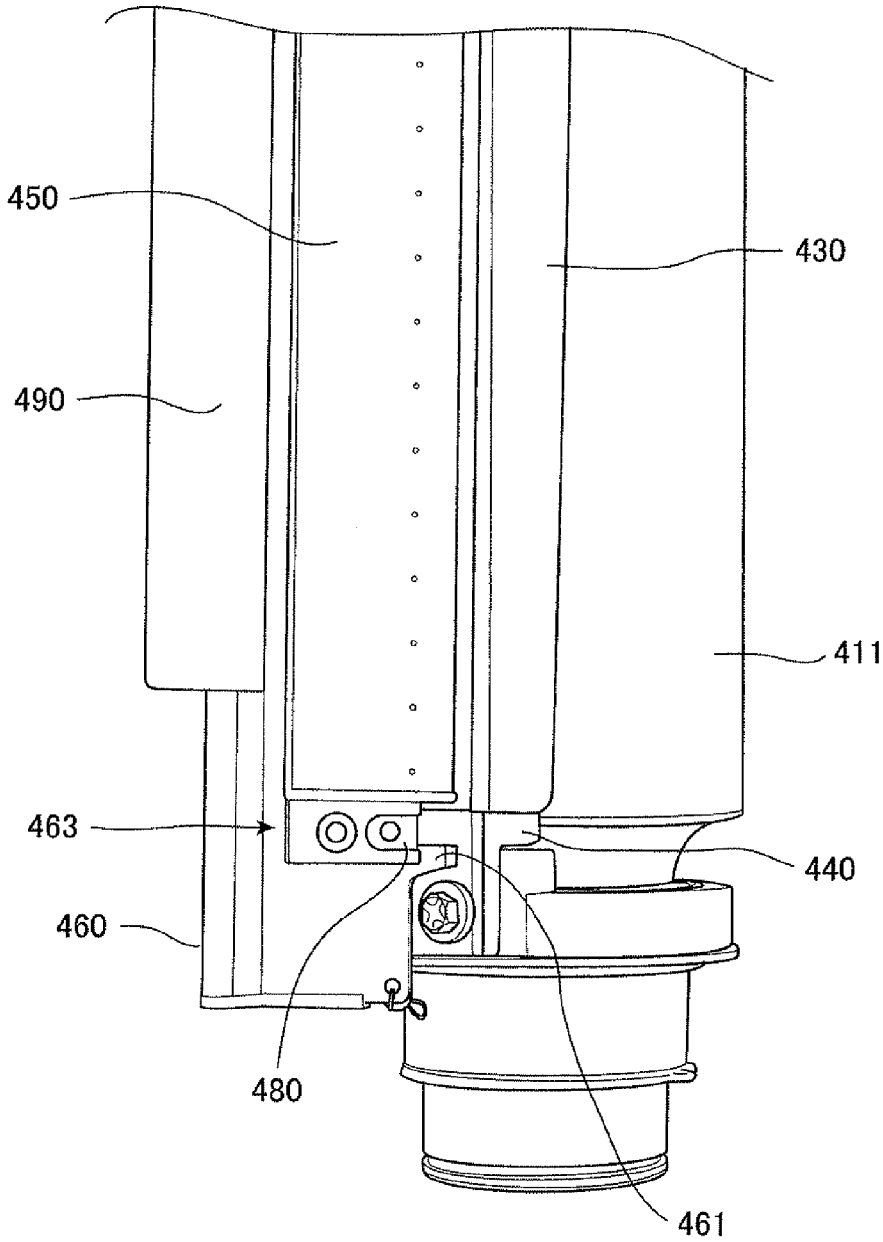
FIG. 12 is an external view of the peeling baffle in a state of being placed at the fixed point of the support base.
Figure 13:
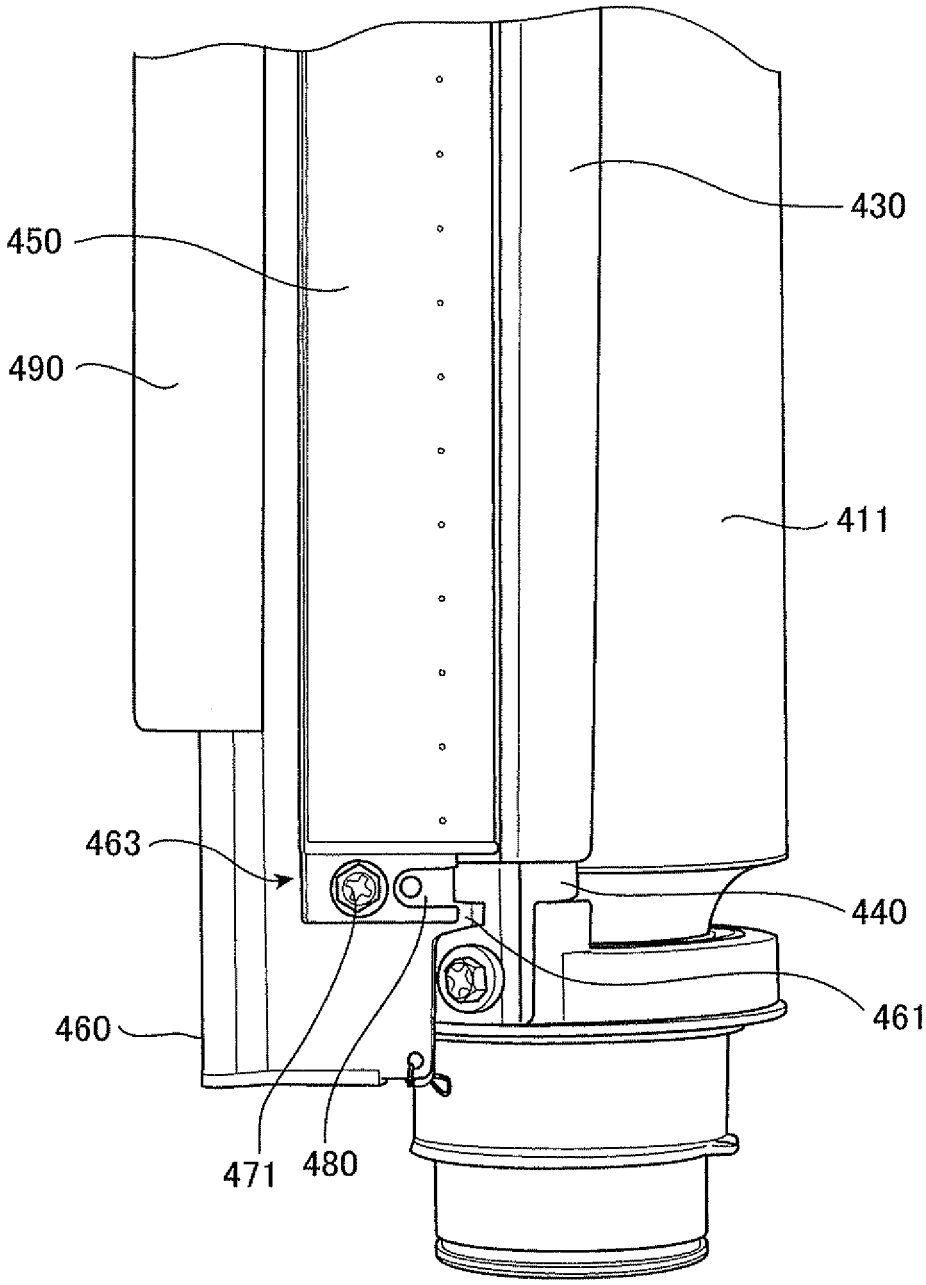
FIG. 13 is an external view of the peeling baffle in a state of being screwed on the fixed point of the support base.
Figure 14:
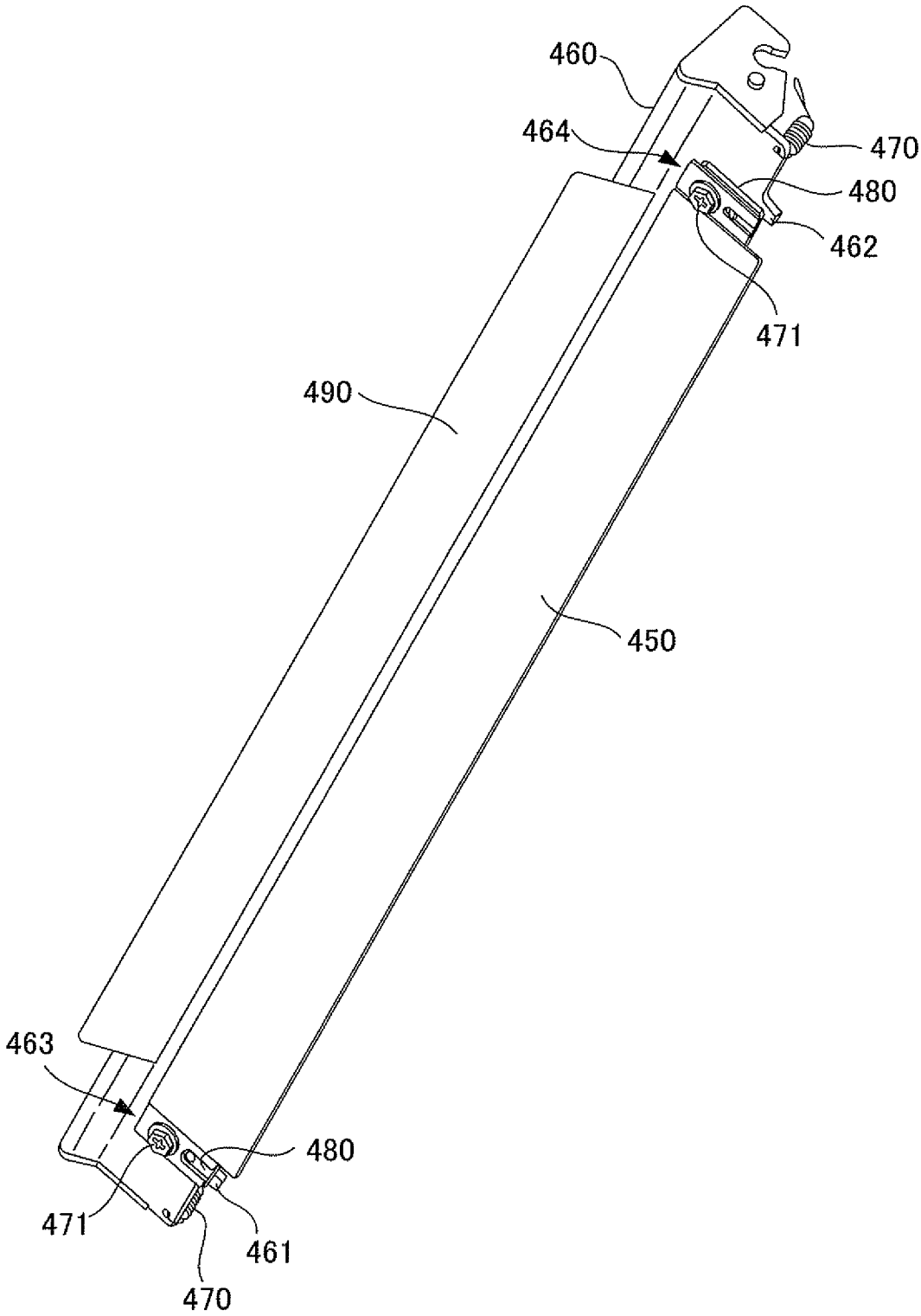
FIG. 14 is a perspective view of the assembly including the peeling baffle, the support base and the protruding member, when viewed obliquely from upper front.
Figure 15:
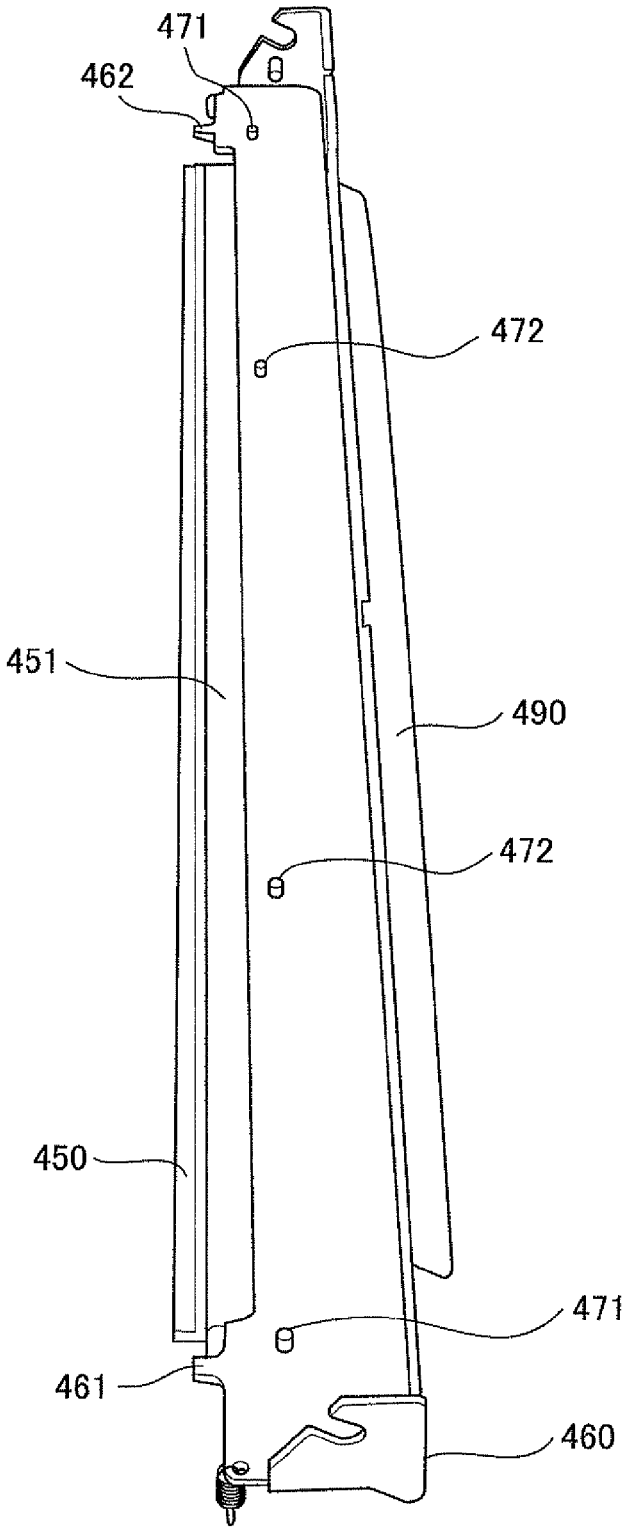
FIG. 15 is a perspective view of the assembly illustrated in FIG. 14 when viewed obliquely from lower front.
Figure 16:
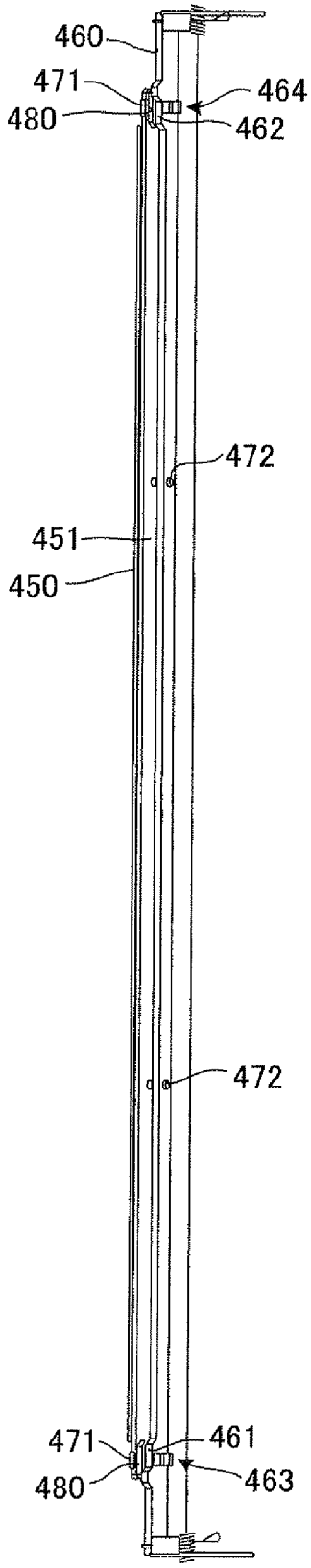
FIG. 16 is a perspective view of the assembly illustrated in FIG. 14 when viewed from a side.
Figure 17:
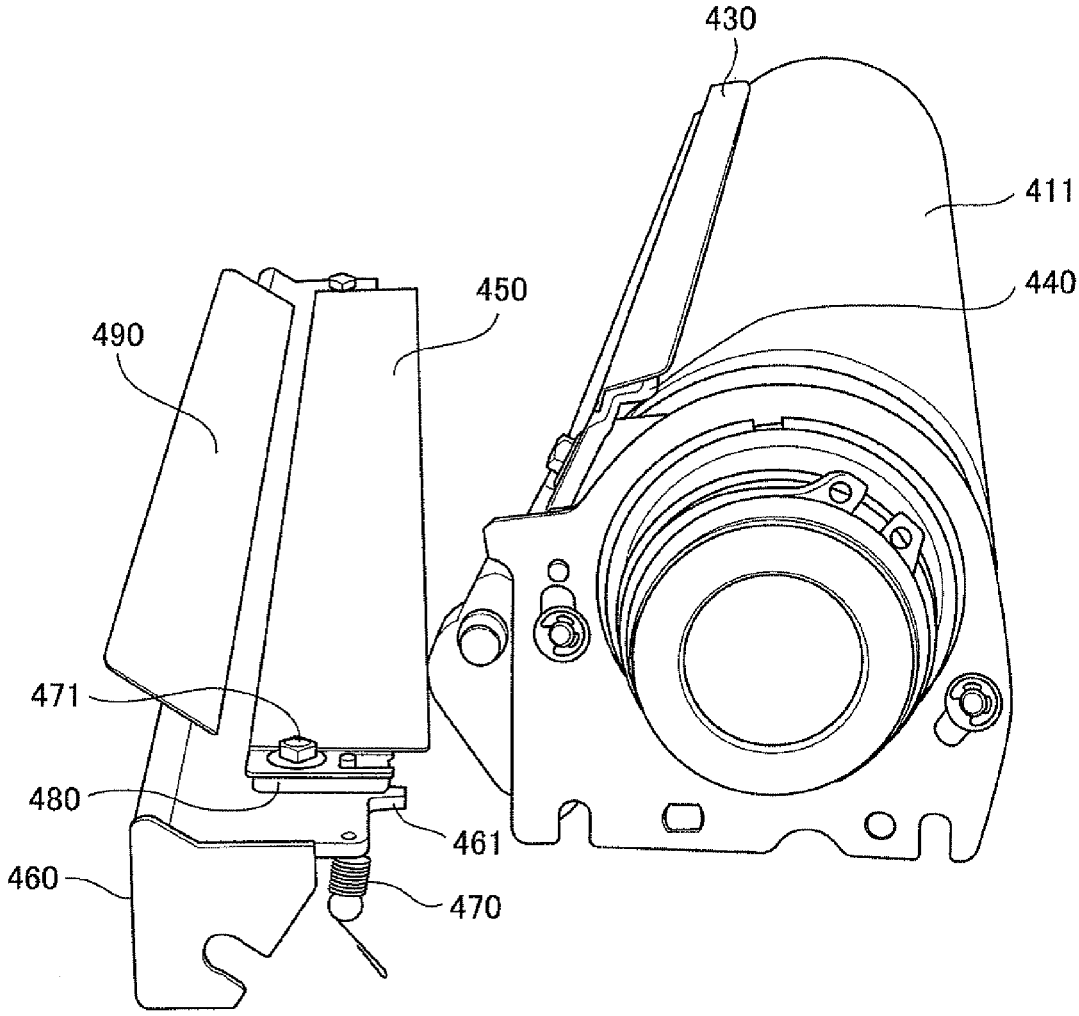
FIG. 17 is a perspective view of the assembly illustrated in FIG. 15 and an assembly including the first heating roll, the peeling pad and the fixed member when viewed obliquely from upper front.
Figure 18:
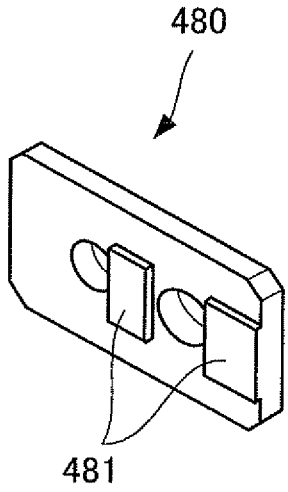
FIG. 18 is a perspective view of a spacer when viewed from a side contacting the support base.

FIG. 10 is a perspective view of the assembly illustrated in FIG. 4 from which the peeling baffle 450 is removed and which is viewed obliquely from upper front, and FIG. 11 is an enlarged external view of a part B illustrated in FIG. 10. FIG. 12 is an external view of the peeling baffle 450 in a state of being placed at the fixed point 463 (464) of the support base 460, and FIG. 13 is an external view of the peeling baffle 450 in a state of being screwed on the fixed point 463 (464) of the support base 460. FIG. 14 is a perspective view of the assembly including the peeling baffle 450, the support base 460 and the protruding member 490, when viewed obliquely from upper front, and FIG. 15 is a perspective view of the assembly illustrated in FIG. 14 when viewed obliquely from lower front. FIG. 16 is a perspective view of the assembly illustrated in FIG. 14 when viewed from a side, and FIG. 17 is a perspective view of the assembly illustrated in FIG. 15 and an assembly including the first heating roll 411, the peeling pad 430 and the fixed member 440 when viewed obliquely from upper front. Further, FIG. 18 is a perspective view of a spacer 480 when viewed from a side contacting the support base 460.

As illustrated in FIG. 10 through FIG. 14, the support base 460 supports the peeling baffle 450 when the peeling baffle 450 is secured by a fixing screw 471 via the spacer 480 at each of the two fixing points 463 and 464 spaced in a direction along the peeling baffle 450. The support base 460 is equivalent to an example of the support base that supports the peeling member and also is equivalent to an example of the support base of the type positioned by abutment against the fixed member. As illustrated in FIG. 18, the spacer 480 is a member forming a space between the support base 460 and the peeling baffle 450 and is in such a shape that at each contact portion 481 that contacts the support base 460, the width in the direction in which the support base 460 extends is smaller than the width of the head of the fixing screw 471. Further, as illustrated in FIG. 10, two screw holes 465 and 466 are formed in the support base 460. These screw holes 465 and 466 are formed between the fixed points 463 and 464 and spaced in a distance shorter than one-third of the distance between the fixed points 463 and 464 from the fixed points 463 and 464, respectively. Furthermore, as illustrated in FIG. 15 and FIG. 16, correction screws 472, which press the peeling baffle 450 in a direction of correcting the curve of the peeling baffle 450, namely in a direction protruding from the support base 460, are engaged in the screw holes 465 and 466. The spacer 480 is equivalent to an example of the space forming body that forms the space between the support base and the peeling member, and the fixing screw 471 is equivalent to an example of the fixing screw that screws the peeling member on the fixed point. The correction screw 472 is equivalent to an example of the correction screw that presses the peeling member in the direction of correcting the curve of the peeling member.

Here, how to adjust the placement of the peeling baffle 450 will be described.

The peeling baffle 450 is adjusted so that the one long side 452 is close to the external circumferential surface of the fixing belt 410, and the distance between the one long side 452 and the external circumferential surface of the fixing belt 410 and the amount of curve of the peeling baffle 450 are ideal. As a result, high pealing performance is achieved, and damage due to the contact with the external circumferential surface of the fixing belt 410 is prevented.

In the following description, "the long side 452 close to the external circumferential surface of the fixing belt 410" is referred to as "an edge of the peeling baffle 450".

To adjust the distance between each point of the edge of the peeling baffle 450 and the external circumferential surface of the fixing belt 410, a jig having a reference surface corresponding to the ideal position of each point of the edge relative to the external circumferential surface is used. To adjust the placement of the peeling baffle 450, at first, the support base 460 is removed from the fixed member 440. Next, the jig is positioned and fixed to the support base 460 by using the positioning projections 461 and 462 of the support base 460. Subsequently, the edge of the peeling baffle 450 is positioned relative to the reference surface of the jig through an operation described below. This operation is carried out in a place sufficiently far away from the fixing belt 410 that is prone to being damaged.

The peeling baffle 450 is secured by the fixing screws 471 via the spacer 480 to the fixed points 463 and 464 of the support base 460, in a state in which the edge abuts on the reference surface of the jig. Here, the contact portions 481 of the spacer 480, which contact the support base 460, have the above-described width in the direction in which the support base 460 extends. Therefore, even if the peeling baffle 450 is firmly secured to the support base 460 with the fixing screws 471, the curve of the peeling baffle 450 remains to the extent of enabling the positional adjustment of the edge.

After securing in this way, the curve of the peeling baffle 450 is corrected to remove the space relative to the reference surface of the jig, through a push by the correction screw 472 protruding from the support base 460 side. Such a curve correction is adjustment with sufficient flexibility, and the state achieved by this correction is maintained stably by the force of the curve of the peeling baffle 450. Incidentally, the curve provided to the peeling baffle 450 may be deviated toward one of the fixed points 463 and 464. However, the curve with such a deviation also is corrected properly by the correction screws 472 engaged in the screw holes 465 and 466 formed at the above-described positions.

After the peeling baffle 450 is positioned relative to the support base 460 in this way, the jig is removed from the support base 460. As a result, the peeling baffle 450 is put in the state of being supported by the support base 460 as illustrated in FIG. 14 through FIG. 17.

After the peeling baffle 450 is thus supported, the support base 460 that supports the peeling baffle 450 is attached to the fixed member 440. At this moment, the support base 460 is attracted to the fixed member 440 by a biasing force of the spring 470, the positioning projections 461 and 462 of the support base 460 abut against the fixed member 440, and the support base 460 returns to the original position precisely. As a result, the peeling baffle 450 is precisely positioned relative to the circulation course R3, and the position of the edge of the peeling baffle 450 is close to an ideal position relative to the external circumferential surface of the fixing belt 410, so that the high peeling performance is realized.

This completes the description of how to adjust the placement of the peeling baffle 450, and the description of the fixing device 40 will be back and continued.

As illustrated in FIG. 2, the fixing device 40 includes the protruding member 490 adhered to the support base 460.

The protruding member 490 is a member made of heat-resistant resin such as polyimide and shaped like a plate as illustrated in FIG. 2 through FIG. 5, FIG. 8 through FIG. 15 and FIG. 17. Further, as illustrated in FIG. 2, the protruding member 490 is disposed downstream from the peeling baffle 450 in a direction in which the paper sheet peeled by the peeling baffle 450 proceeds. Furthermore, the protruding member 490 protrudes from the peeling baffle 450 side to the paper sheet side and slopes toward the downstream side in the direction in which the paper sheet peeled by the peeling baffle 450 proceeds. The protruding member 490 is equivalent to an example of the protruding member protruding from the peeling member side to the recording medium side.

Next, basic operations before and after the fixing by the fixing device 40 configured as described above and basic operations of the fixing device 40 will be described.

As illustrated in FIG. 1, the paper sheet with the surface to which the toner images are transferred by the secondary transfer device 30 is conveyed and sent to the fixing device 40 by the belt conveyance devices 65.

The paper sheet with the surface where the toner images yet to be fixed are formed is sent to the fixing device 40, and then, as illustrated in FIG. 2, when the paper sheet passes through the pressing position of the fixing device 40, the toners forming the toner images yet to be fixed on the surface of the paper sheet are melted by the fixing belt 410 heated by the heat source 401 provided in each of the first heating roll 411, the second heating roll 412 and the third heating roll 413. Subsequently, at the pressing position, the toner images are fixed to the surface of the paper sheet by being pressed against the external circumferential surface of the fixing belt 410 by the pressing roll 420. In this way, the image made up of the fixed toner images is formed on the paper sheet.

After passing through the pressing position and the image is formed, the paper sheet is peeled from the external circumferential surface of the fixing belt 410 by the peeling pad 430 that pushes up the fixing belt 410 from the internal circumferential surface side to the external circumferential surface side of the fixing belt 410. Subsequently, when the peeling is insufficient, the paper sheet is peeled from the external circumferential surface of the fixing belt 410 by the peeling baffle 450 provided along the external circumferential surface of the fixing belt 410. The paper sheet after being peeled from the external circumferential surface of the fixing belt 410 is conveyed toward the cooling section 74 by the belt conveyance device 65.

Here, as mentioned earlier, the protruding member 490 formed by the plate made of heat-resistance resin is adhered to a rear end of the support base 460 that supports the peeling baffle 450, namely to a downstream end in the direction in which the paper sheet peeled by the peeling baffle 450 proceeds. As illustrated in FIG. 2, the protruding member 490 protrudes from the peeling baffle 450 side to the paper sheet side and slopes downstream in the direction in which the paper sheet peeled by the peeling baffle 450 proceeds. Further, the belt conveyance device 65 that conveys the paper sheet from the fixing device 40 to the cooling section 74 is disposed, as illustrated in FIG. 2, downstream from the peeling baffle 450 in the direction in which the paper sheet peeled by the peeling baffle 450 proceeds. Furthermore, as mentioned earlier, the belt conveyance device 65 conveys the paper sheet by making the paper sheet cling to the external circumferential surface of the belt 65*a*. The paper sheet peeled from the external circumferential surface of the fixing belt 410 may take a shape curling on the peeling baffle 450 side, upon being peeled off the external circumferential surface of the fixing belt 410. This occurs due to any of factors such as the type of paper sheet, an adhesive force produced by the toner with respect to the fixing belt 410, repulsion of the pressing roll 420, and an electrostatic adhesive force to the peeling baffle 450. In this case, without the protruding member 490, the paper sheet may deviate from the original conveyance course, causing a so-called paper jam. In the image forming device 1 of the present exemplary embodiment, the paper sheet peeled off the external circumferential surface of the fixing belt 410 is guided by the protruding member 490 to leave the peeling baffle 450 and made cling to the belt conveyance device 65. As a result, occurrence of a paper jam is prevented, and the paper sheet is reliably guided to move downstream in the direction in which the paper sheet proceeds.

Incidentally, in the exemplary embodiment, the tandem type of color printer is described as an example of the image forming device of the present invention. However, the image forming device of the present invention is not limited to this example, and may be any type of image forming device as long as an image forming section and a recording medium peeling device are included.

Further, in the exemplary embodiment, the fixing device is described as an example of the recording medium peeling device of the present invention, but the recording medium peeling device of the present invention is not limited to this example and may be any device that peels a recording medium after passing through a pressing position from a moving surface, such as a transfer device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A recording medium peeling device comprising:

a moving section that has a moving surface circulating along a circulation course;

a pressing section that presses a recording medium passing through a pressing position in the circulation course against the moving surface at the pressing position;

a peeling member that is disposed downstream from the pressing position and apart from the moving surface, and extends in a direction crossing a direction of circulation, and that peels the recording medium after passing through the pressing position from the moving surface, the peeling member being curved; and a support base that is removably attached to the moving section and includes a supporting surface that supports the peeling member for mounting the peeling member at a mounting position, the support base further including at least one positioning member that extends in a direction toward the moving surface, wherein the peeling member is configured to be secured to fixed points of the supporting surface of the support base, the fixed points being at opposite ends of the support surface, and the curve in the peeling member is adjustable.

2. The recording medium peeling device according to claim 1, wherein the moving section includes a heat source which emits heat, and heats the moving surface with the heat source, the recording medium has a surface where a toner image yet to be fixed is formed, and the pressing section presses the recording medium passing through the pressing position against the moving surface at the pressing position so as to fix the toner image on the surface of the recording medium.

3. The recording medium peeling device according to claim 1, further comprising a protruding member that is disposed downstream from the peeling member in a direction in which the recording medium after being peeled by the peeling member proceeds, that protrudes from the peeling member side to the recording medium side, and that slopes downstream.

4. An image forming device comprising:

an image forming section that forms an image on a surface of a recording medium;

a moving section that has a moving surface circulating along a circulation course;

a pressing section that presses a recording medium passing through a pressing position in the circulation course against the moving surface at the pressing position;

a peeling member that is disposed downstream from the pressing position and apart from the moving surface, and extends in a direction crossing a direction of circulation, and that peels the recording medium after passing through the pressing position from the moving surface, the peeling member being curved;

a support base that is removably attached to the moving section and includes a supporting surface that supports the peeling member for mounting the peeling member at a mounting position, the support base further including at least one positioning member that extends in a direction toward the moving surface; and a protruding member that is disposed downstream from the peeling member in a direction in which the recording medium after being peeled by the peeling member proceeds, that protrudes from the peeling member side to the recording medium side, and that slopes downstream, wherein the peeling member is configured to be secured to fixed points of the supporting surface of the support base, the fixed points being at opposite ends of the support surface, and the curve in the peeling member is adjustable.

5. The image forming device according to claim 4, further comprising a conveyor that is disposed downstream from the peeling member in the direction in which the recording medium after being peeled by-the peeling member proceeds, and that sucks and conveys the recording medium.

6. The recording medium peeling device according to claim 3, wherein the protruding member is a plate made of heat-resistant resin.

7. The recording medium peeling device according to claim 1, wherein the peeling member includes an edge that is opposed to the moving surface, and the peeling member is mounted on the supporting surface.

8. The recording medium peeling device according to claim 1, wherein the support base further includes curve correction members that are configured to contact an under surface of the peeling member that is opposed to the supporting surface, and are adjustable to adjust a curvature of the peeling member.

9. The recording medium peeling device according to claim 8, wherein the curve correction members are screws that contact the under surface of the peeling member and are adjustable to push the under surface of the peeling member away from the supporting surface of the support base.

10. A method for adjusting the position of a peeling member in a recording medium device that includes (i) a moving section that has a moving surface circulating along a circulation course, (ii) a pressing section that presses a recording medium passing through a pressing position in the circulation course against the moving surface at the pressing position, (iii) the peeling member, disposed downstream from the pressing position and apart from the moving surface, and extends in a direction crossing a direction of circulation, and that peels a recording medium after passing through the pressing position from the moving surface, the peeling member being curved, and (iv) a support base that is removably attached to the moving section and includes a supporting surface that supports the peeling member for mounting the peeling member thereon, the method comprising:

securing the peeling member to fixed points of the supporting surface of the support base, the fixed points being at opposite ends of the support surface; and adjusting the curve in the peeling member.

11. The method of claim 10, further comprising attaching the support base to the moving section.

12. The method of claim 11, wherein the support base further including at least one positioning member that extends in a direction toward the moving surface.

13. The method of claim 12, wherein the moving section includes a fixed member that is fixed relative thereto and the support base is spring biased toward the fixed member in a position where the positioning member abuts against the fixed member.

14. The method of claim 10, wherein the curvature of the peeling member is adjusted by adjusting curve correction screws that contact an under surface of the peeling member that is opposed to the supporting surface.

15. The method of claim 10, wherein the step of mounting the peeling member includes interposing a spacer between the peeling member and the support base and affixing the peeling member to the support base at a fixed point through the spacer.

16. The recording medium peeling device according to claim 1, wherein the peeling member is fixed to the supporting surface with fixing screws.

17. The recording medium peeling device according to claim 1, wherein the curve in the peeling member is configured to be adjustable at a plurality of locations along a length of the peeling member.

18. The recording medium peeling device according to claim 1, further comprising curve correction screws that contact an under surface of the peeling member that is opposed to the supporting surface adapted to adjust the curvature of the peeling member by pressing the peeling member in a direction protruding from the support base.

19. The recording medium peeling device according to claim 1, further comprising a spacer interposed between the peeling member and the support base and affixing the peeling member to the support base at a fixed point.

20. The image forming device according to claim 4, wherein the peeling member is fixed to the supporting surface with fixing screws.

21. The image forming device according to claim 4, wherein the curve in the peeling member is configured to be adjustable at a plurality of locations along a length of the peeling member.

22. The image forming device according to claim 4, further comprising curve correction screws that contact an under surface of the peeling member that is opposed to the supporting surface adapted to adjust the curvature of the peeling member by pressing the peeling member in a direction protruding from the support base.

23. The image forming device according to claim 4, further comprising a spacer interposed between the peeling member and the support base and affixing the peeling member to the support base at a fixed point.

24. The method of claim 10, further comprising fixing the peeling member to the supporting surface with fixing screws.

25. The method of claim 10, further comprising adjusting the curve in the peeling member at a plurality of locations along a length of the peeling member.

26. The method of claim 10, wherein adjusting the curve in the peeling member comprises pressing the peeling member in a direction protruding from the support base with curve correction screws that contact an under surface of the peeling member that is opposed to the supporting surface.

27. The method of claim 10, further comprising interposing a spacer between the peeling member and the support base and affixing the peeling member to the support base at a fixed point.

* * * * *